US009593546B2

(12) United States Patent
Wright et al.

(10) Patent No.: US 9,593,546 B2
(45) Date of Patent: Mar. 14, 2017

(54) WELL TOOLS INCORPORATING VALVES OPERABLE BY LOW ELECTRICAL POWER INPUT

(75) Inventors: Adam D. Wright, Al Khobar (SA); Michael L. Fripp, Carrollton, TX (US); Kevin D. Fink, Frisco, TX (US); Donald Perkins, Allen, TX (US); Jimmie R. Williamson, Carrollton, TX (US); Mark D. Kalman, Luthersville, GA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/489,504

(22) Filed: Jun. 6, 2012

(65) Prior Publication Data

US 2012/0241143 A1 Sep. 27, 2012

Related U.S. Application Data

(62) Division of application No. 12/353,664, filed on Jan. 14, 2009, now Pat. No. 8,235,103.

(51) Int. Cl.
*E21B 23/04* (2006.01)
*E21B 41/00* (2006.01)

(52) U.S. Cl.
CPC ..... *E21B 23/04* (2013.01); *E21B 41/00* (2013.01)

(58) Field of Classification Search
CPC ..... E21B 41/00; E21B 23/04; E21B 34/06; E21B 34/063
USPC ..... 166/373, 376, 317, 316
See application file for complete search history.

(56) References Cited

U.S. PATENT DOCUMENTS

| | | | |
|---|---|---|---|
| 2,918,125 | A | 12/1959 | Sweetman |
| 3,195,637 | A | 7/1965 | Wayne |
| 4,796,699 | A | 1/1989 | Upchurch |
| 4,856,595 | A | 8/1989 | Upchurch |

(Continued)

FOREIGN PATENT DOCUMENTS

WO 2004018833 A1 3/2004

OTHER PUBLICATIONS

Halliburton Armada Sampling System Product Brochure, 2007, 2 pages.

(Continued)

*Primary Examiner* — Brad Harcourt
(74) *Attorney, Agent, or Firm* — Chamberlain Hrdlicka

(57) ABSTRACT

Well tools including valves operable by low electrical input. One well tool includes a valve which controls fluid communication between pressure regions in a well, the valve including a rotatable member which is biased to rotate, and a brake or clutch which prevents rotation of the member. Another valve includes a barrier which separates reactants, with the valve being operable in response to the barrier being opened and the reactants thereby reacting with each other. Yet another valve includes a barrier which separates the pressure regions, and a control circuit which heats the barrier to a weakened state. Another valve includes a member displaceable between open and closed positions, a restraining device which resists displacement of the member, and a control device which degrades or deactivates the restraining device and thereby permits the member to displace between its open and closed positions, in response to receipt of a predetermined signal.

10 Claims, 8 Drawing Sheets

(56) References Cited

U.S. PATENT DOCUMENTS

| | | | |
|---|---|---|---|
| 5,058,674 | A | 10/1991 | Schultz et al. |
| 5,117,548 | A | 6/1992 | Griffith et al. |
| 5,155,471 | A | 10/1992 | Ellis et al. |
| 5,188,183 | A | 2/1993 | Hopmann et al. |
| 5,279,321 | A | 1/1994 | Krimm |
| 5,558,153 | A | 9/1996 | Holcombe et al. |
| 5,575,331 | A | 11/1996 | Terrell |
| 5,622,211 | A | 4/1997 | Martin et al. |
| 6,172,614 | B1 | 1/2001 | Robison et al. |
| 6,196,584 | B1 | 3/2001 | Shirk et al. |
| 6,364,037 | B1 | 4/2002 | Brunnert et al. |
| 6,382,234 | B1 | 5/2002 | Birckhead et al. |
| 6,438,070 | B1 | 8/2002 | Birchak et al. |
| 6,450,258 | B2 | 9/2002 | Green et al. |
| 6,450,263 | B1 | 9/2002 | Schwendemann |
| 6,584,911 | B2 | 7/2003 | Bergerson et al. |
| 6,619,388 | B2 | 9/2003 | Dietz et al. |
| 6,668,937 | B1 | 12/2003 | Murray |
| 6,925,937 | B2 | 8/2005 | Robertson |
| 7,197,923 | B1 | 4/2007 | Wright et al. |
| 7,373,944 | B2 | 5/2008 | Smith et al. |
| 2002/0108747 | A1 | 8/2002 | Dietz et al. |
| 2005/0199401 | A1* | 9/2005 | Patel et al. ..... 166/387 |
| 2006/0131030 | A1 | 6/2006 | Sheffield |
| 2007/0084607 | A1 | 4/2007 | Wright et al. |
| 2007/0204995 | A1 | 9/2007 | Hofman |
| 2007/0272410 | A1 | 11/2007 | Hromas |
| 2007/0284118 | A1* | 12/2007 | Benton ..... 166/386 |
| 2008/0257031 | A1 | 10/2008 | Irani |
| 2010/0175867 | A1 | 7/2010 | Wright et al. |

OTHER PUBLICATIONS

Magneta Electromagnetic Clutch Brakes catalog, Jan. 2004, 28 pages.
Danaher Motion Brakes website, Mar. 4, 2009, 3 pages.
Ogura Electromagnetic Clutch Brakes webeite, Mar. 4, 2009, 4 pages.
Halliburion Drawing 672.03800, May 4, 1994, p. 1 of 2.
Halliburton Drawing 672.03800, May 4, 1994, p. 2 of 2.
Halliburton Drawing 626.02100, Apr. 20, 1999, 2 pages.
Office Action issued May 27, 2011 for U.S. Appl. No. 12/353,664, 15 pages.
Office Action issued Nov. 15, 2011 for U.S. Appl. No. 12/353,664, 7 pages.

* cited by examiner

WELL TOOLS INCORPORATING VALVES OPERABLE BY LOW ELECTRICAL POWER INPUT

CROSS-REFERENCE TO RELATED APPLICATION(S)

This application is a division of prior application Ser. No. 12/353,664 filed on 14 Jan. 2009. The entire disclosure of this prior application is incorporated herein by this reference.

BACKGROUND

The present disclosure relates generally to equipment utilized and operations performed in conjunction with a subterranean well and, in an embodiment described herein, more particularly provides a well tool incorporating a valve operable by low electrical power input.

It is becoming more common to operate well tools using battery power, or using electrical power generated downhole. Unfortunately, these power sources typically do not provide a large amount of electrical power and/or do not provide electrical power for long periods of time.

Therefore, it may be seen that a need exists for well tools which may be operated using low electrical power input.

SUMMARY

In the present specification, a well tool is provided which solves at least one problem in the art. One example is described below in which the well tool includes a valve which is operable using a low electrical power input. Another example is described below in which the electrical power input is used to heat, melt or combust a material.

In one aspect, a well tool is provided that includes a valve which controls fluid communication between pressure regions in a well. Various types of valves are described below. One valve includes a rotatable member which is biased to rotate, and a brake or clutch which prevents rotation of the member. Another valve includes a barrier which separates reactants, and the valve is operable in response to the barrier being opened and the reactants thereby reacting with each other.

Yet another valve includes a member displaceable between an open position in which fluid communication between the pressure regions is permitted and a closed position in which fluid communication between the pressure regions is prevented. A restraining device resists displacement of the member between its open and closed positions. A control device degrades or deactivates the restraining device and thereby permits the member to displace between its open and closed positions, in response to receipt of a predetermined signal.

Another valve includes a barrier which separates the pressure regions, and a control circuit which causes the barrier to be heated to a weakened state. Thermite may be used to heat the barrier. In its weakened state, the barrier may permit fluid communication between the initially separated pressure regions.

These and other features, advantages and benefits will become apparent to one of ordinary skill in the art upon careful consideration of the detailed description of representative embodiments below and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used merely for convenience in referring to the accompanying drawings.

Figure 1:
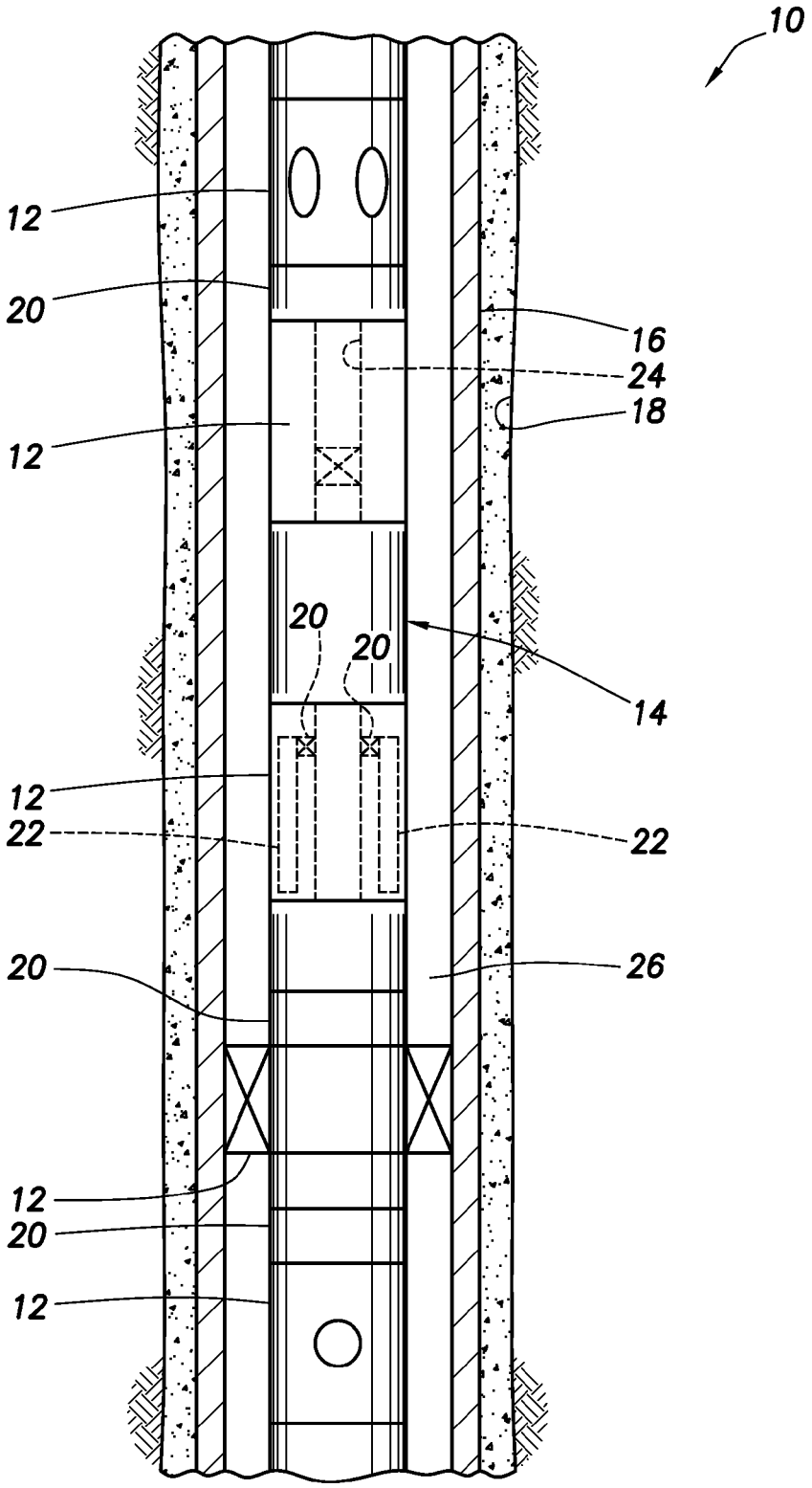
FIG. 1 is a schematic partially cross-sectional view of a well system embodying principles of the present disclosure.

Representatively illustrated in FIG. 1 is a well system 10 which embodies principles of the present disclosure. In the well system 10, several well tools 12 are interconnected in a tubular string 14 installed in casing 16 cemented in a wellbore 18. The well tools 12 include actuators 20 for operating corresponding ones of the well tools 12.

The uppermost one of the well tools 12 is depicted in FIG. 1 as being a circulating valve, the next lower well tool is a tester valve, the next is a multi-sampler tool, the next is a packer, and the lowermost is a production valve or choke. These well tools 12 are provided merely as examples of the wide variety of well tools which can incorporate the principles described in this disclosure.

However, it should be clearly understood that those principles are not limited at all to only the well system 10, well tools 12 and actuators 20 described herein. Many other well systems, well tools, actuators, etc. can incorporate the principles of this disclosure.

For example, it is not necessary for a well tool to be interconnected in a tubular string, for a wellbore to be cased, for an actuator to be an integral part of a well tool (e.g., the actuator could be separately connected to the well tool), etc. Any type of well system, well tool and/or actuator can use the principles described herein.

As depicted in FIG. 1, one of the actuators 20 is used to open and close the circulating valve and tester valve well tools 12, additional actuators are used to control flow into sample chambers 22, another actuator is used to set the packer, and yet another actuator is used to selectively open and close the production valve or choke. In each of these cases, the actuator 20 is used to operate the corresponding well tool(s) 12 by controlling fluid communication between pressure regions in the well. For example, when the pressure regions are blocked from one another, a well tool 12 is in one position, and when there is fluid communication between the pressure regions, the well tool is actuated to another position.

The pressure regions could be, for example, an interior flow passage 24 of the tubular string 14, an annulus 26 formed radially between the tubular string and the casing 16 or wellbore 18, the interiors of the sample chambers 22, pressurized chambers (such as a chamber charged with nitrogen gas, etc.), atmospheric chambers, sections of a control line leading from the surface to a well tool 12, sections of a control line between well tools, etc. Any type of pressure region may be used in keeping with the principles of this disclosure.

In one unique aspect of the well system 10, the actuators 20 include valves which are operable with low electrical power input. The valves are used to control communication between the pressure regions in the well, and are described more fully below.

However, it should be clearly understood that the principles of this disclosure are not limited to any particular construction details of the examples of the valves described below and depicted in the drawings. These examples are used merely to illustrate how the principles of this disclosure can be incorporated to actuate well tools.

An example of a packer which may be set using an actuator which may incorporate the valves described below is disclosed in U.S. Pat. No. 5,558,153, the entire disclosure of which is incorporated herein by this reference. Examples of samplers which may incorporate the actuators and valves described below are disclosed in U.S. Pat. No. 7,197,923 and in U.S. Published Application No. 2008-0257031, the entire disclosures of which are incorporated herein by this reference. An example of a circulating valve which may incorporate the actuators and valves described below is disclosed in U.S. patent application Ser. No. 12/203,011, filed Sep. 2, 2008, the entire disclosure of which is incorporated herein by this reference.

Figure 2A:
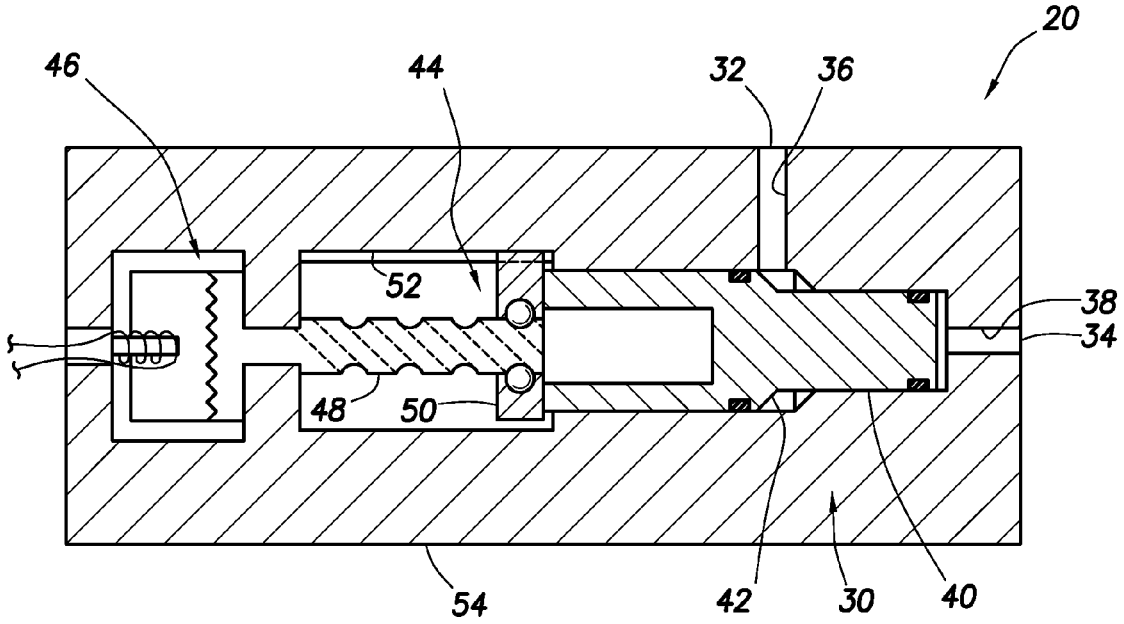
FIGS. 2A & B are enlarged scale schematic cross-sectional views of a valve which may be used in a well tool in the system of FIG. 1, the valve being in a closed configuration in FIG. 2A, and in an open configuration in FIG. 2B.

Referring additionally now to FIGS. 2A & B, a valve 30 for one of the actuators 20 is representatively illustrated. The valve 30 is used to control communication between pressure regions 32, 34. For example, a port 36 of the valve 30 could be connected to a relatively high pressure region 32 (such as a pressurized gas chamber, the flow passage 24, etc.), and another port 38 of the valve could be connected to a relatively low pressure region 34 (such as an atmospheric chamber, the sample chambers 22, etc.).

In FIG. 2A, the valve 30 is in a closed configuration with a plug or piston 40 blocking communication between the ports 36, 38. The piston 40 is biased to the left (as viewed in FIG. 2A) by pressure acting on a differential piston area 42, but displacement of the piston to the left is prevented by a ball screw arrangement 44 and a solenoid operated brake or clutch 46 which initially prevents rotation of a threaded member 48 of the ball screw arrangement.

In this example, a nut 50 of the ball screw arrangement 44 is restrained from rotating due to its engagement with a slot 52 extending longitudinally along an interior of a housing 54. Since the brake or clutch 46 also prevents rotation of the member 48, the piston 40 cannot displace to the left.

As used herein, the terms "brake" and "clutch" are used interchangeably to indicate a device which selectively prevents and permits rotation of one member relative to another. Note that the brake or clutch 46 could be deactivated to permit rotation of the member 48, or the nut 50 could be disengaged from the slot 52 to permit rotation of the nut, in order to operate the valve 30. These two actions (deactivation of the brake or clutch 46, and disengagement of the nut 50 from the slot 52) could be independently performed.

Figure 2B:
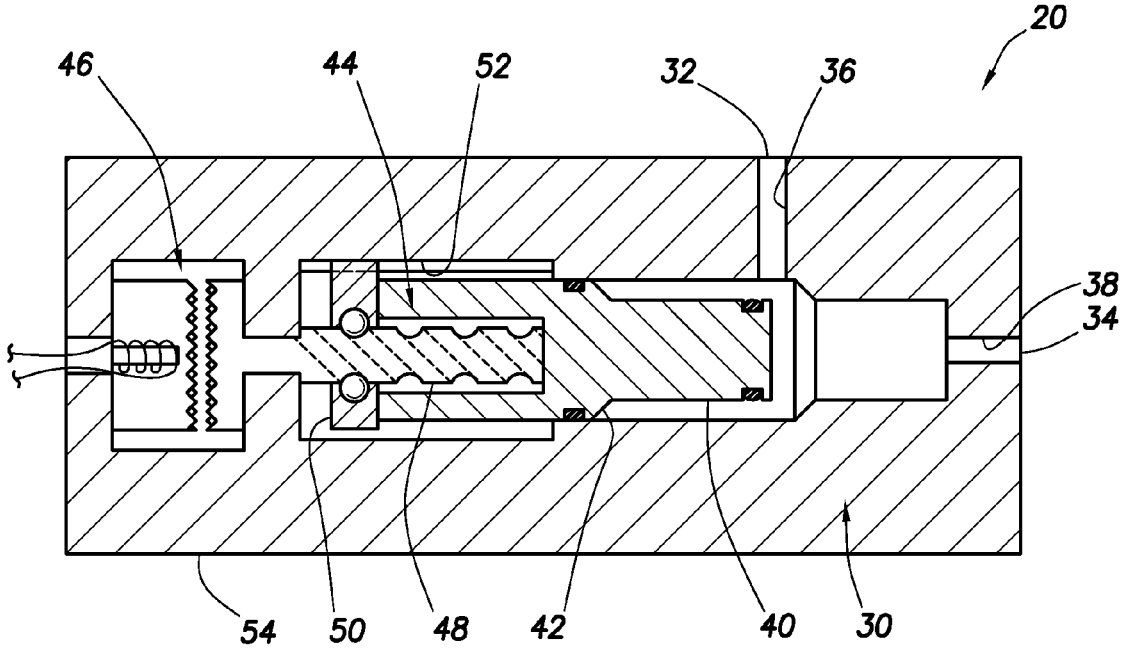

In FIG. 2B, the brake or clutch 46 has been disengaged from the member 48, thereby permitting it to rotate into the nut 50 and allowing the piston 40 to displace to the left. Communication is now permitted between the pressure regions 32, 34 via the ports 36, 38.

Preferably, only a low amount of electrical power is needed to disengage the brake or clutch 46 and permit the member 48 to rotate. Note that, although the threaded member 48 is depicted in the drawings as being externally threaded, it could instead be internally threaded, the nut 50 could instead be permitted to rotate by operation of the brake or clutch 46, etc. Furthermore, although the ball screw arrangement 44 has the member 48 in compression as described above and illustrated in the drawings, the member 48 could instead be in tension (for example, if it were positioned on the opposite side of the piston 40, or if the differential piston area on the piston 40 faces the opposite direction, etc.).

Figure 3A:
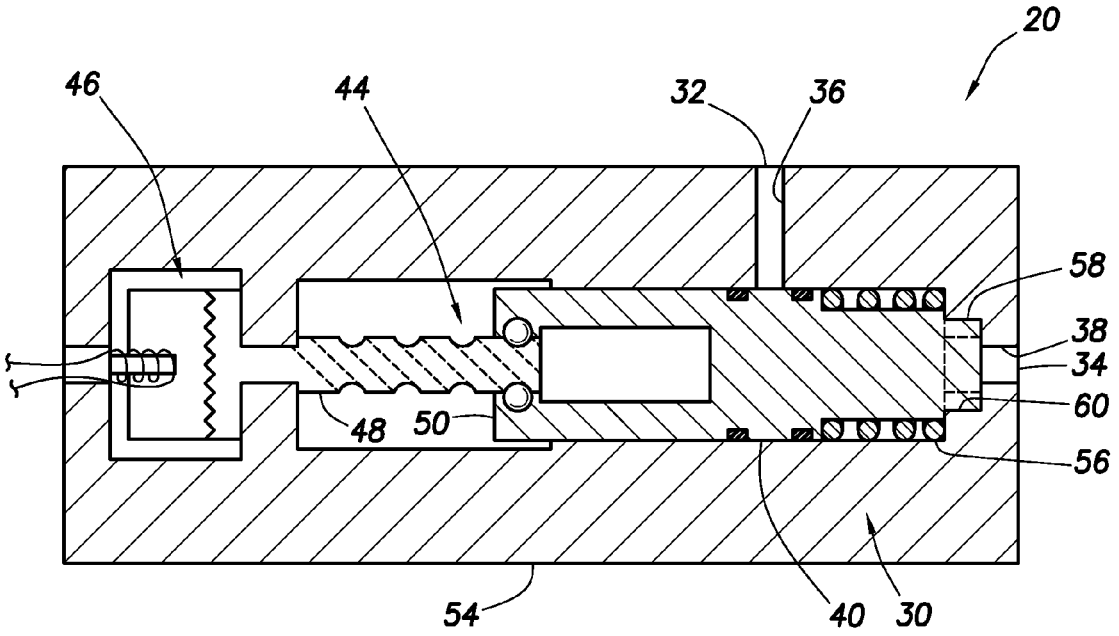
FIGS. 3A & B are schematic cross-sectional views of another configuration of the valve, the valve being in a closed configuration in FIG. 3A, and in an open configuration in FIG. 3B.

Referring additionally now to FIGS. 3A & B, another configuration of the valve 30 is representatively illustrated. In this configuration, the nut 50 is incorporated into an end of the piston 40, and a separate biasing device 56 (such as a spring) is used to bias the piston to the left (as viewed in FIGS. 3A & B).

The biasing device 56 takes the place of the piston area 42, which is simply another type of biasing device. Any other type of biasing device (such as a pressurized chamber, compressed material, etc.) may be used in keeping with the principles of this disclosure.

In FIG. 3A, the piston 40 is prevented from rotating due to splined or other anti-rotation engagement between an end 58 of the piston and a complimentarily shaped recess 60 in the housing 54. The piston 40, thus, cannot displace to the left and prevents communication between the pressure regions 32, 34.

Figure 3B:
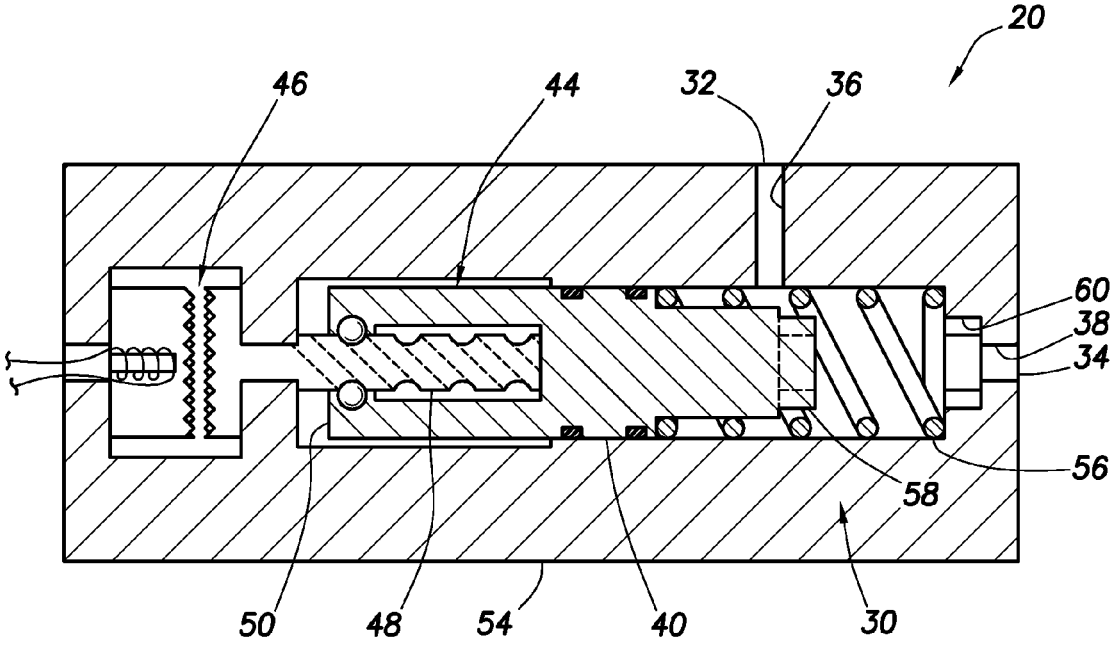

In FIG. 3B, the brake or clutch 46 is disengaged, thereby permitting rotation of the member 48, and permitting the piston 40 to displace to the left. Communication is now permitted between the pressure regions 32, 34 via the ports 36, 38.

Preferably, disengagement of the brake or clutch 46 is performed in response to a signal received at the corresponding well tool 12 (or at an associated signal receiver) downhole. For example, various forms of telemetry (such as acoustic, pressure pulse, tubular string manipulation, or electromagnetic telemetry, etc.) may be used to transmit an appropriate signal to a control device including a signal detector and a control circuit which interprets the signal and determines whether the valve 30 should be operated. Some examples of control devices, control circuits, signal detectors, telemetry, etc. are described below and schematically illustrated in the drawings, but it should be clearly understood that the principles of this disclosure are not limited to the details of these specific examples.

Figure 4:
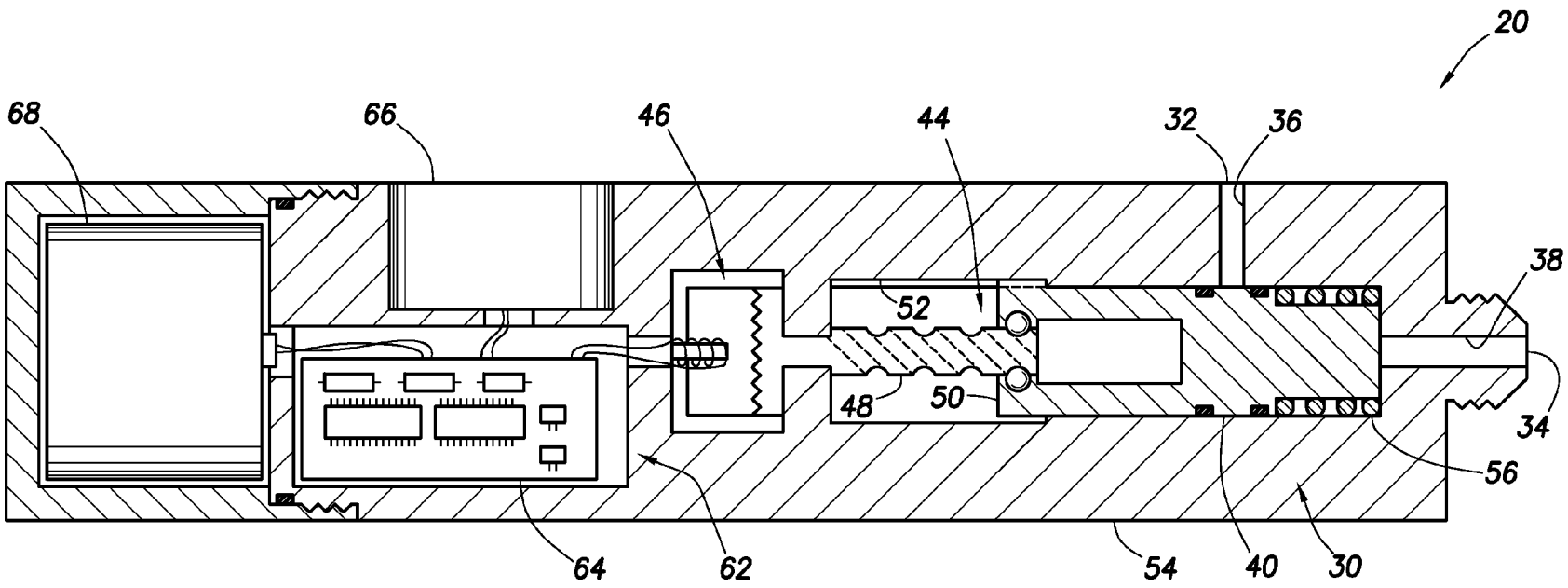
FIG. 4 is a schematic cross-sectional view of yet another configuration of the valve.

Referring additionally now to FIG. 4, another configuration of the valve 30 is representatively illustrated, along with an associated control device 62, control circuit 64, signal detector 66 and electrical power supply 68. The valve 30 is similar in many respects to the valves of FIGS. 2A-3B, except that the piston 40 is prevented from rotating due to engagement between the nut 50 and the slot 52, with the nut being incorporated into the piston.

The power supply 68 is depicted in FIG. 4 as comprising a battery, but other types of power supplies can be used in keeping with the principles of this disclosure. For example, a downhole electrical power generator could be used instead of, or in addition to, a battery. A current source (such as a capacitor) could be used in conjunction with one or more batteries in the power supply 68.

The signal detector 66 may be a pressure sensor, a strain sensor, a hydrophone, an antenna or any other type of signal detector which is capable of receiving a telemetry signal. However, it should be appreciated that the signal detector 66 may be replaced by other types of sensors, and the valve 30 could be operated in response to, for example, detection of a certain physical property (such as pressure, temperature, resistivity, oil/gas ratio, water cut, radioactivity, etc.), passage of a certain period of time, etc.

The control circuit 64 could be an electronic circuit which includes a microprocessor, memory, etc. to analyze the input from the signal detector and/or other sensor(s), and to determine whether the valve 30 should be operated. If the valve 30 is to be operated, the control circuit 64 applies power from the power supply 68 to the brake or clutch 46 solenoid, in order to open the valve.

The control circuit 64 could include a microprocessor which is programmed to recognize a "signature" (such as a pattern or particular type of signal amplitude, phase, etc.) and a piezoelectric switch which closes an electric circuit between the power supply 68 and a heating element, fusible link, ignitor, solenoid, etc., as described below.

Of course, the control device 62, control circuit 64, signal detector 66 and power supply 68 can be used to operate valves other than the valve 30. For example, representatively illustrated in FIG. 5 is another valve 70 which can be operated using the control device 62 (including the control circuit 64 and signal detector 66).

Figure 5:
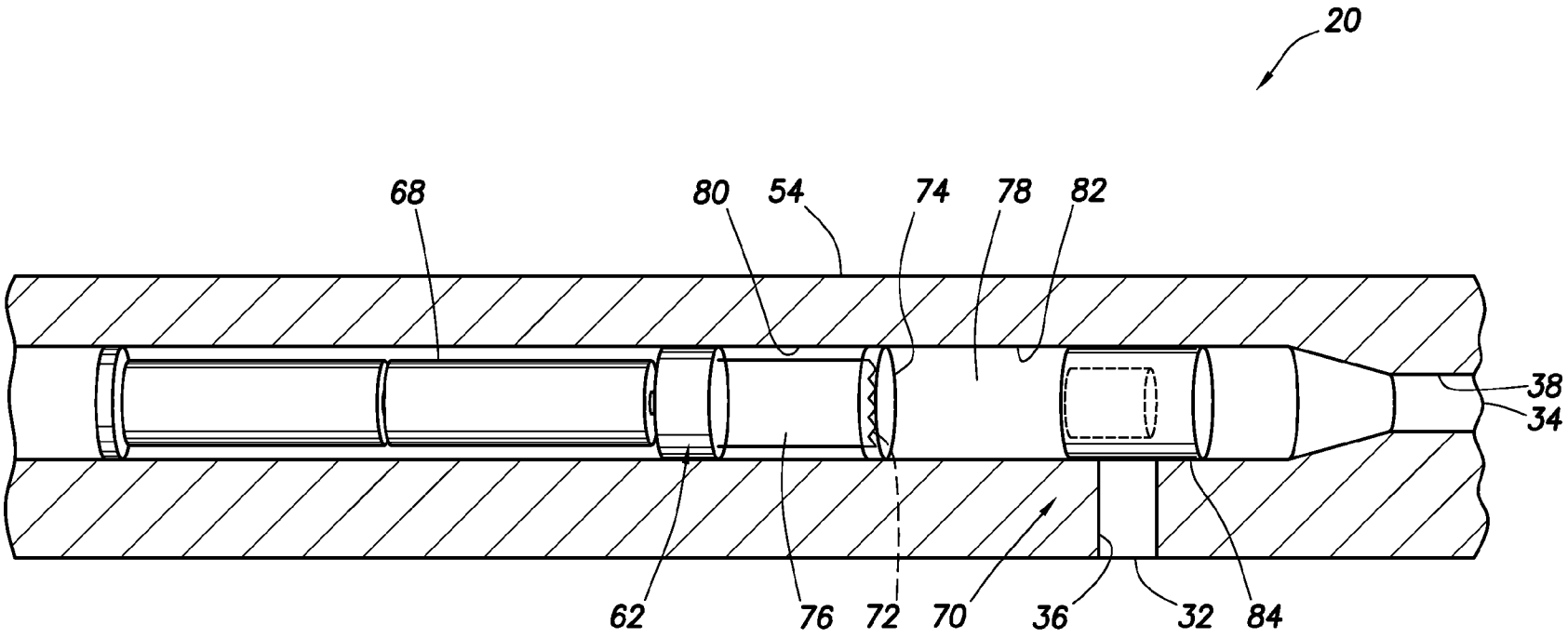
FIG. 5 is a schematic partially cross-sectional view of another valve which may be used in a well tool in the system of FIG. 1.

In the example of FIG. 5, the control device 62 is connected to an electrical heating element 72 in contact with (or within) a barrier 74 separating reactants 76, 78 in respective chambers 80, 82 on opposite sides of the barrier. When the control circuit 64 of the device 62 determines that the valve 70 should be operated, electrical power is supplied from the power supply 68 to the heating element 72 to melt, combust, ignite or otherwise degrade the barrier 74, so that the reactants 76, 78 can react with each other.

A plug member 84 initially prevents communication between the pressure regions 32, 34. However, when the reactants 76, 78 react with each other, the plug member 84 is thereby displaced, dissolved, corroded or otherwise degraded or deactivated, so that communication is then permitted between the pressure regions 32, 34.

For example, the reactants 76, 78 could be such that an exothermic reaction is produced when they are in contact with each other, thereby melting the plug 84 or generating pressure to displace the plug. As another example, the reactants 76, 78 could be such that an acid (such as hydrochloric acid) is produced when they are in contact with each other, thereby dissolving the plug 84. As yet another example, the reactants 76, 78 could be sodium hydroxide and water, and the plug 84 could be made of an aluminum alloy, so that when the reactants mix the plug is dissolved.

An exothermic reaction could be produced by contacting sodium hydroxide with an aluminum alloy, as described in U.S. Pat. No. 3,195,637. Alternatively, the reactants 76, 78 could be as described in U.S. Pat. No. 5,177,548, e.g., a powdered mixture of ferric oxide ($Fe_2O_3$) and aluminum. Examples of other suitable materials that produce the desired exothermic reaction when ignited include a powdered mixture of manganese dioxide ($MNO_2$) and aluminum, a powdered mixture of sodium chlorate ($NaClO_3$) and aluminum, and a powdered mixture of sodium chlorate ($NaClO_3$) and calcium.

As another alternative, the reactants 76, 78 could be as described in U.S. Pat. No. 5,575,331, which refers to U.S. Pat. No. 2,918,125, both of which disclose downhole chemical cutters employing "fluorine and the halogen fluorides including such compounds as chlorine trifluoride, chlorine monofluoride, bromine trifluoride, bromine pentafluoride, iodine pentafluoride and iodine heptafluoride." These reactants 76, 78 would cause a very high temperature reaction, so that the amount used would preferably be very well controlled.

Another preferred embodiment is to dissolve the removable plug 84, which could be made of aluminum or magnesium, as described in U.S. Pat. No. 5,622,211. In this particular embodiment, when the barrier 74 is removed, a high concentration of hydrochloric or other acid comes into contact with the removable plug 84 and dissolves the plug. The acid could be in the chamber 80 shielded from the plug 84 by the barrier 74, or two reactants 76, 78 which combine to form an acid could be separated by the barrier 74, which when removed would cause the chemical reaction to form the acid, which then dissolves the plug.

Many other combinations of reactants 76, 78 and materials for the plug 84 may be used in keeping with the principles of this disclosure. The plug 84 could be hollowed out, as depicted in FIG. 5, to provide more surface area, reduce the plug thickness or otherwise speed up the dissolving or corroding process.

Instead of using the heating element 72, the barrier 74 could be opened by means of a solenoid valve or other type of valve to thereby allow the reactants 76, 78 to react with each other.

Figure 6:
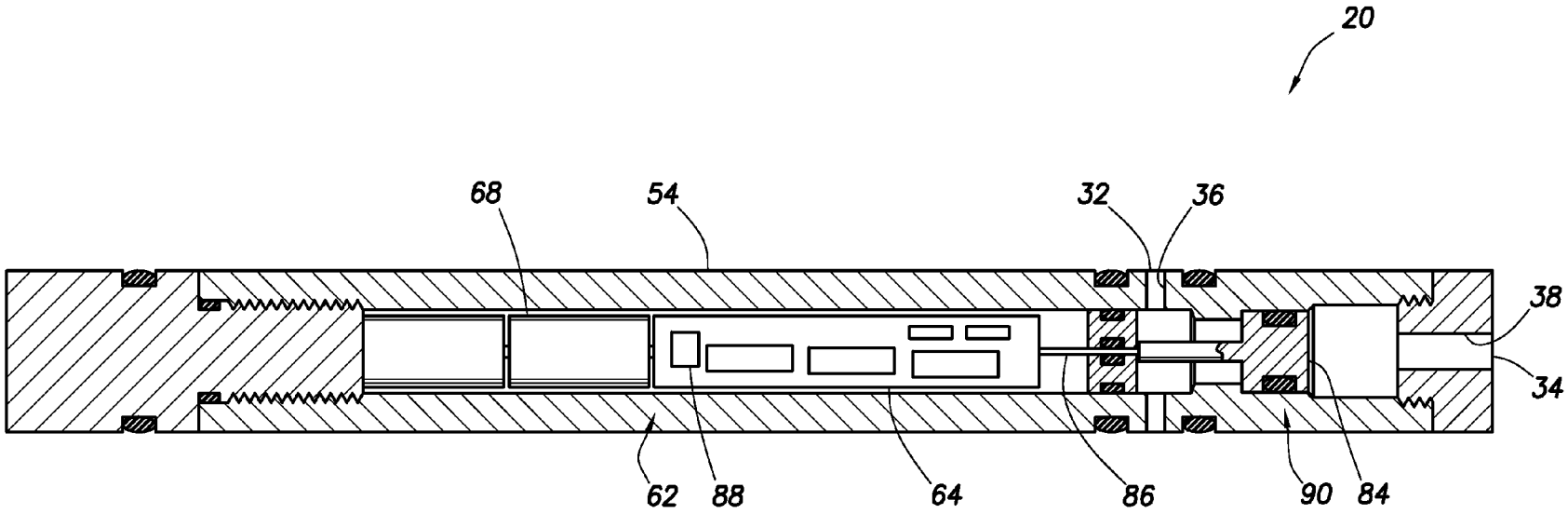
FIG. 6 is a schematic cross-sectional view of yet another valve which may be used in a well tool in the system of FIG. 1.

Referring additionally now to FIG. 6, another valve 90 is representatively illustrated. In this example, the plug member 84 is in the form of a piston which is displaced to the right (as viewed in FIG. 6) due to a pressure differential from the pressure region 32 to the pressure region 34 when a restraining device 86 is broken, melted, weakened and/or otherwise degraded.

For example, the restraining device 86 may be a fusible link which is broken when electrical power is supplied to it from the control circuit 64. The restraining device 86 could comprise a eutectic material. The restraining device 86 could include high strength polymer fibers which initially prevent the plug member 84 from displacing to the right, until the fibers are weakened or broken, such as by melting, heat degradation, disintegration or reduction of elastic modulus (e.g., using a heating element such as the heating element 72 described above), using electrical power supplied by the control circuit 64.

The control circuit 64 could include a timer 88 to initiate degrading or deactivating of the restraining device 86 after a certain period of time, and/or the control circuit could be connected to a signal detector (e.g., the signal detector 66 described above) or other type of sensor, so that the restraining device is degraded or deactivated when an appropriate signal is received or an appropriate property is sensed.

Figure 7:
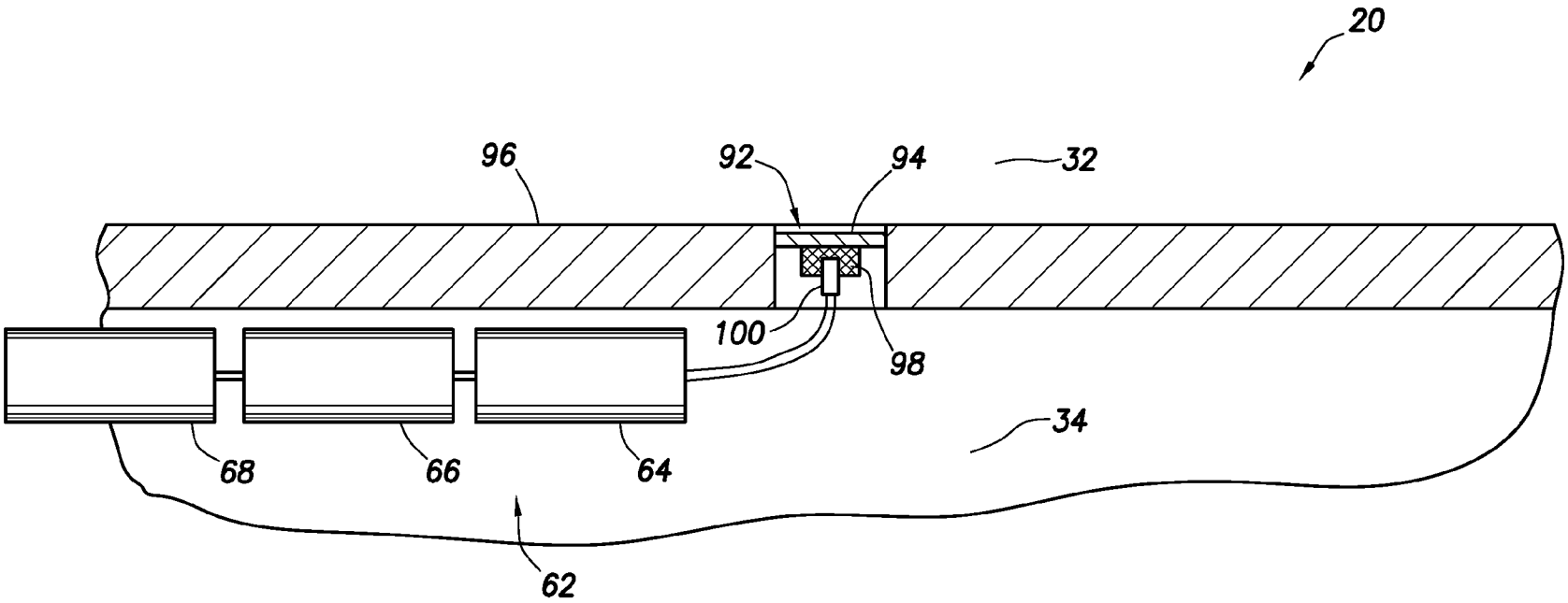
FIG. 7 is a schematic cross-sectional view of a further valve which may be used in a well tool in the system of FIG. 1.

Referring additionally now to FIG. 7, another valve 92 is representatively illustrated for use in providing selective communication between the pressure regions 32, 34. In this example, the pressure regions 32, 34 are separated by a barrier 94 in a wall 96 between the pressure regions. Communication is provided between the pressure regions 32, 34 by heating, melting or otherwise degrading or deactivating the barrier 94.

For example, the barrier 94 can be heated to a weakened state by igniting a material 98 in close proximity to the barrier 94. The material 98 could be a thermite material or another mixture of aluminum and iron oxide particles which produces substantial heat when ignited. In a preferred embodiment, the material 98 may be formed from a mixture of 25% fine grain THERMIT™ and 75% coarse grain THERMIT™ by weight.

The barrier 94 can be made of metal, plastic, composite, glass, ceramic, a mixture of these materials, or any other material.

An ignitor 100 could be connected to the control circuit 64 so that, when it is determined that the valve 92 should be operated, the control circuit supplies electrical power to the ignitor. This causes the material 98 to ignite and thereby weaken the barrier 94. The ignitor 100 could be similar to an electric match (e.g., comprising a bridge wire and a pyrogen).

Preferably, the material 98 is not an explosive which detonates and blasts through the barrier 94 (which would require adherence to explosives regulations), but an explosive could be used if desired.

The ignitor 100 could comprise a heating element, such as the heating element 72 described above. For example, the ignitor 100 could comprise a nickel-chromium alloy wire which is heated by electrical current supplied by the control circuit 64.

The material 98 is preferably used to create heat. In a preferred embodiment, the material 98 comprises a type of thermite (chemicals using the Goldschmidt reaction). The material 98 could include a wide variety of metals (fuel) and metal oxides (oxidizer) including iron, aluminum, manganese, copper, chromium, zinc, and magnesium. The material 98 could use micron or nanoscale particles, but micron-sized are preferred due their relative safety over nano-scale particles. TEFLON™, VITON™, or a fluoropolymer could be used to enhance the exothermal chemical reaction (e.g., fluorine in the material could be liberated in the reaction to thereby react with magnesium to generate heat). Other pyrotechnic or exothermal reactions could be used in addition to the thermite reaction.

Thermite is particularly appealing for downhole use because it does not have significant temperature limitations. Extended use above 200 C is expected with a thermite as the exothermal chemical.

The material 98 can include a binder to hold the included chemicals together. Possible binders include TEFLON™, VITON™, PBAN (polybutadiene acrylonitrile copolymer), HTPB (hydroxyl-terminated polybutadiene), and epoxy.

The exothermal chemical reaction can create a hole in the barrier 94 using at least one of four methods: 1) jetting, 2) melting, 3) weakening, or 4) pressure. In the jetting method, the exothermal chemical reaction creates a hot jet that is directed towards the barrier 94. The hot jet causes a focused hot spot on the barrier 94. Using the jet allows for using less exothermal chemicals and reduces the sensitivity to heat transfer.

In the melting method, the exothermal chemicals are placed proximate to the barrier 94. In a preferred embodiment, the exothermal chemicals are epoxied to the barrier 94 but it could have a metallic, ceramic, plastic, composite and/or epoxy protective cover over the chemicals. The chemical reaction creates heat which conducts, convects and/or radiates (preferably mostly conducts) into the barrier 94. The heat melts a hole in the barrier 94.

In the weakening method, the exothermal chemicals are placed proximate to the barrier 94. The heat from the chemical reaction reduces the strength of the materials in the barrier 94. The pressure differential across the barrier 94 causes the barrier to mechanically fail due to the reduced strength. The strength of the barrier 94 can be reduced either by reducing the failure stress of the parts due to heat or by reducing the strength of a mechanical joint.

In the pressure method, the exothermal chemicals create gaseous pressure which causes the barrier 94 to fail. In a preferred embodiment, the pressure is generated from chemicals that are placed inside of the barrier 94. The generated pressure causes the barrier 94 to burst, which allows fluid communication.

Figure 8:
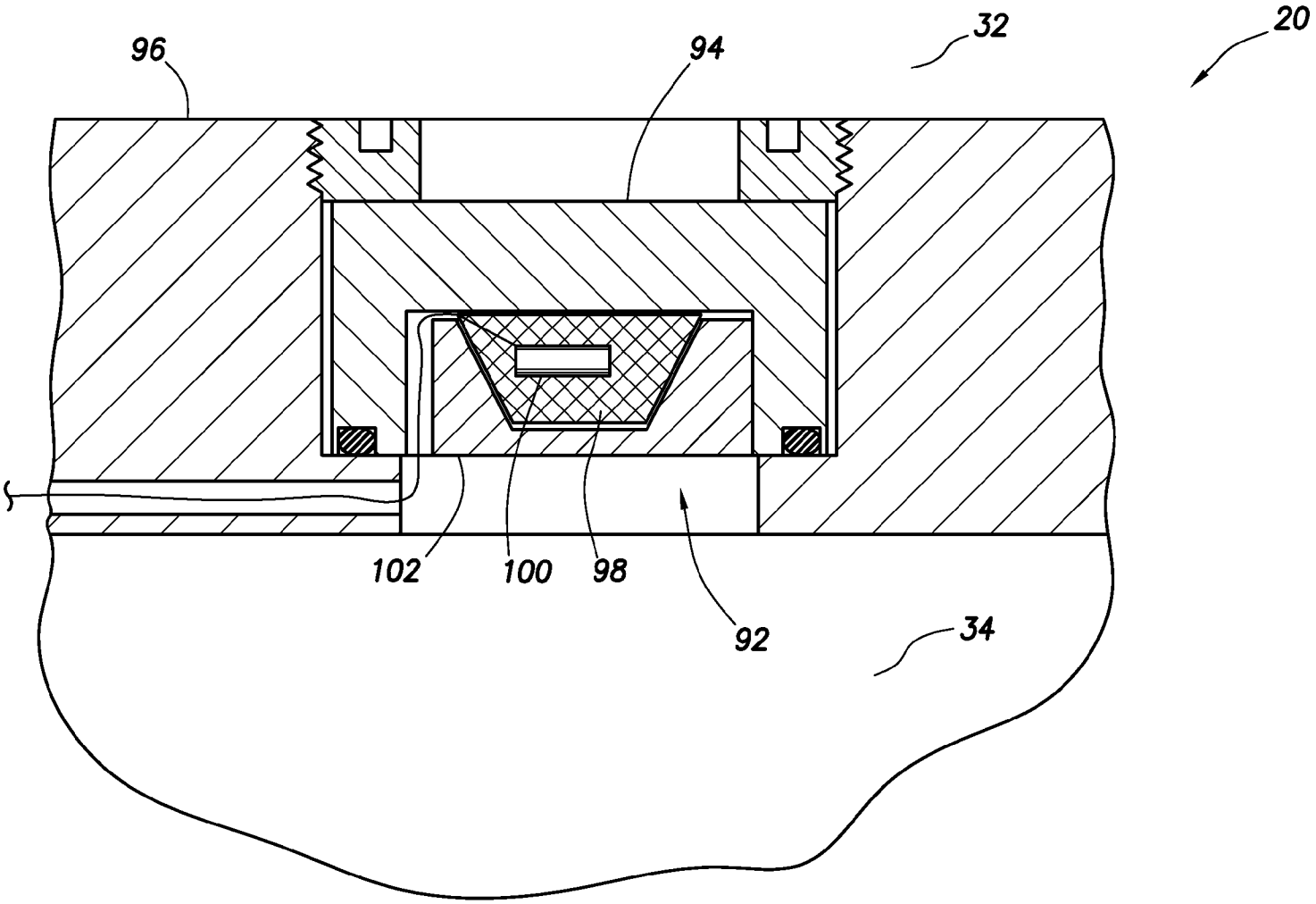
FIG. 8 is a schematic cross-sectional view of another valve which may be used in a well tool in the system of FIG. 1.

Referring additionally now to FIG. 8, another configuration of the valve 92 is representatively illustrated. In this example, the barrier 94 is in the form of a plug installed in the wall 96.

A support 102 holds the material 98 adjacent the barrier 94, so that the barrier is efficiently weakened or otherwise degraded when the material is ignited. The support 102 can be part of the barrier 94, in which case the material 98 is contained within the barrier.

Note that, in the configurations of FIGS. 7 & 8, the material 98 is not necessarily ignited. For example, any material or combination of materials which can generate an exothermic reaction may be used for the material 98.

It may now be fully appreciated that the above disclosure provides several advancements to the art of actuating well tools and operating valves thereof. The valves 30, 70, 90, 92 described above conveniently provide for actuation of well tools 12, without requiring much electrical power to operate.

In particular, the above disclosure describes a well tool 12 that includes a valve 30 which controls fluid communication between pressure regions 32, 34 in a well. The valve 30 includes a rotatable member 48 which is biased to rotate, and a brake or clutch 46 which prevents rotation of the member 48. Electrical power is applied to the brake or clutch 46 to deactivate the brake or clutch 46 and permit rotation of the member 48.

Rotation of the member 48 in response to deactivation of the brake 46 may operate the valve 30 to either an open position or a closed position.

The rotatable member 48 may be biased to rotate by a piston area 42. The piston area 42 may be exposed to pressure in at least one of the pressure regions 32, 34. The rotatable member 48 may be biased to rotate by a biasing device 56.

The rotatable member 48 may comprise an internally threaded member or an externally threaded member.

The valve 30 may include a signal detector 66 and a control circuit 64, whereby upon receipt of a predetermined signal by the signal detector 66, the control circuit 64 may deactivate the brake 46 and thereby permit rotation of the member 48. The control circuit 64 may control application of electrical power to the brake 46.

Another well tool 12 described by the above disclosure includes a valve 70 which controls fluid communication between pressure regions 32, 34 in a well. The valve 70 includes a barrier 74 which separates reactants 76, 78. The valve 70 is operable in response to the barrier 74 being opened and the reactants 76, 78 thereby reacting with each other.

The valve 70 may also include a plug 84 isolating the pressure regions 32, 34 from each other. At least a portion of the plug 84 may be dissolvable by a product of the reactants 76, 78. A product of the reactants 76, 78 may be corrosive to at least a portion of the plug 84. An exothermic reaction may be produced when the reactants 76, 78 react with each other. At least a portion of the plug 84 is weakened, broken, melted or disintegrated by the exothermic reaction.

Pressure may be produced when the reactants 76, 78 react with each other. A member (e.g., the plug 84) may displace in response to the produced pressure, thereby controlling fluid communication between the pressure regions 32, 34.

The valve 70 may include a signal detector 66 and a control circuit 64. Upon receipt of a predetermined signal by the signal detector 66, the control circuit 64 may open the barrier 74. The control circuit 64 may cause the barrier 74 to be heated, broken, weakened, combusted or melted in response to receipt of the predetermined signal by the signal detector 66.

The above disclosure also describes another well tool 12 including a valve 90 which controls fluid communication between pressure regions 32, 34 in a well. The valve 90 includes: a) a member 84 displaceable between an open position in which fluid communication between the pressure regions 32, 34 is permitted and a closed position in which fluid communication between the pressure regions 32, 34 is prevented, b) a restraining device 86 which resists displacement of the member 84 between its open and closed positions, and c) a control device 62 which degrades or deactivates the restraining device 86 and thereby permits the member 84 to displace between its open and closed positions, in response to receipt of a predetermined signal.

The control device 62 may include a control circuit 64 which causes the restraining device 86 to be weakened, broken, combusted and/or heated in response to receipt of the predetermined signal by a signal detector 66. The member 84 may be biased to displace between its open and closed positions by a difference between pressures in the pressure regions 32, 34.

Yet another well tool 12 is described by the above disclosure. The well tool 12 includes a valve 92 which controls fluid communication between pressure regions 32, 34 in a well. The valve 92 includes a barrier 94 which separates the pressure regions 32, 34, and a control circuit 64 which causes the barrier 94 to be heated to a weakened state.

The valve 92 may also include a signal detector 66. The control circuit 64 may cause the barrier 94 to be heated to a weakened state in response to receipt of a predetermined signal by the signal detector 66. The predetermined signal may comprise a fluid pressure signal, an electromagnetic signal or an acoustic signal.

The barrier 94 in its weakened state may permit fluid communication between the pressure regions 32, 34 in response to a difference between pressures in the pressure regions 32, 34.

The valve 92 may include a thermite material. The control circuit 64 may ignite the thermite material to thereby heat the barrier 94.

The valve 92 may include a mixture of aluminum and iron oxide particles. The control circuit 64 may cause the mixture to be ignited to thereby heat the barrier 94.

The control circuit 64 may cause the barrier 94 to be heated in response to passage of a predetermined period of time.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. For example, the control device 62 could be a mechanically or pressure operated device, or any other type of control device, instead of, or in addition to, including the control circuit 64. Accordingly, the foregoing detailed description is to be clearly understood as being given by way of illustration and example only, the spirit and scope of the present invention being limited solely by the appended claims and their equivalents.

What is claimed is:

1. A well tool, comprising a valve which controls fluid communication in a well, the valve including:

a barrier which separates reactants and is degradable in response to being heated to allow the reactants to react with each other; and a plug that isolates pressure regions, the plug being responsive to a reaction between the reactants so as to be degraded or deactivated to permit communication between the pressure regions.

2. The well tool of claim 1, wherein at least a portion of the plug is dissolvable by a product of the reactants.

3. The well tool of claim 1, wherein a product of the reactants is corrosive to at least a portion of the plug.

4. The well tool of claim 1, wherein an exothermic reaction is produced when the reactants react with each other, and wherein at least a portion of the plug is weakened, melted or disintegrated by the exothermic reaction.

5. The well tool of claim 1, wherein pressure is produced when the reactants react with each other.

6. The well tool of claim 5, wherein the plug is displaced in response to the produced pressure, thereby controlling fluid communication between the pressure regions.

7. The well tool of claim 1, wherein the valve further includes a signal detector and a control circuit, whereby upon receipt of a predetermined signal by the signal detector, the control circuit degrades the barrier.

8. The well tool of claim 7, wherein the control circuit causes the barrier to be heated in response to receipt of the predetermined signal by the signal detector.

9. The well tool of claim 7, wherein the control circuit causes the barrier to be combusted in response to receipt of the predetermined signal by the signal detector.

10. The well tool of claim 7, wherein the control circuit causes the barrier to be melted in response to receipt of the predetermined signal by the signal detector.

* * * * *